US008179325B2

(12) United States Patent
Edwards et al.

(10) Patent No.: US 8,179,325 B2
(45) Date of Patent: May 15, 2012

(54) PLANAR TRIPOLAR ANTENNA

(76) Inventors: David J. Edwards, Oxfordshire (GB); Tong Hao, Oxfordshire (GB); Wasim Q Malik, Oxfordshire (GB); Christopher J. Stevens, Oxfordshire (GB)

( * ) Notice: Subject to any disclaimer, the term of this patent is extended or adjusted under 35 U.S.C. 154(b) by 0 days.

(21) Appl. No.: 12/521,595

(22) PCT Filed: Jan. 2, 2008

(86) PCT No.: PCT/GB2008/050004

§ 371 (c)(1),
(2), (4) Date: Sep. 15, 2010

(87) PCT Pub. No.: WO2008/081200

PCT Pub. Date: Jul. 10, 2008

(65) Prior Publication Data

US 2011/0006960 A1 Jan. 13, 2011

(30) Foreign Application Priority Data

Jan. 6, 2007 (GB) ..... 0700218.1

(51) Int. Cl.
*H01Q 1/38* (2006.01)

(52) U.S. Cl. ..... 343/700 MS; 343/725; 343/795

(58) Field of Classification Search ..... 343/700, 343/725, 727, 795

See application file for complete search history.

(56) References Cited

U.S. PATENT DOCUMENTS 5,068,669 A * 11/1991 Koert et al. ..... 343/700 MS
6,400,332 B1 6/2002 Tsai et al.
7,151,500 B2 * 12/2006 Su et al. ..... 343/795
7,307,590 B1 * 12/2007 Tonn ..... 343/700 MS
7,532,114 B2 * 5/2009 Stilp ..... 340/539.22
2006/0071870 A1 4/2006 Saito et al.
2007/0139273 A1 * 6/2007 Durham et al. ..... 343/700 MS

FOREIGN PATENT DOCUMENTS

WO WO 2006/049382 A1 5/2006

OTHER PUBLICATIONS

Nabar et al., "Performance of Multi-Antenna Signaling Strategies Using Dual-Polarized Antennas: Measurement Results and Analysis," Wireless Personal Communications 23: 31-44 (2002).

* cited by examiner

*Primary Examiner* — Tho G Phan
(74) *Attorney, Agent, or Firm* — Myers Bigel Sibley & Sajovec, P.A.

(57) ABSTRACT

A tripolar antenna is described having at least two electromagnetic signal transmitting/receiving elements arranged such that their axes of signal transmission/reception sensitivity are not parallel, wherein said elements are provided on or at least partially in a substrate of dielectric material so portions of said at least two elements are coplanar and dielectrically isolated from one another. In a preferred arrangement, two dipoles are provided on the substrate in perpendicular orientation and in the plane containing of the surface of said dielectric material. Most preferably a further third element is provided so as to render the antenna tripolar, said third element comprising a first circular disk element secured to an upper surface of the dielectric material, and a second slightly larger circular disk element, concentrically positioned on the corresponding opposite and lower surface of the dielectric.

14 Claims, 3 Drawing Sheets

PLANAR TRIPOLAR ANTENNA

RELATED APPLICATIONS

The present application is a 35 U.S.C. §371 national phase application of PCT International Application No. PCT/GB2008/050004, having an international filing date of Jan. 2, 2008, claiming priority to Great Britain Patent Application No. 0700218.1, filed Jan. 6, 2007. The disclosures of each application are incorporated herein by reference in their entireties. The above PCT International Application was published in the English language and has International Publication No. WO 2008/081200 A1.

This invention relates to a planar tripolar antenna, being one which is capable of receiving and/or transmitting electromagnetic radiation which is polarised along three ideally orthogonal, axes.

BACKGROUND

The notion of providing dipolar and tripolar antennae, at least in terms of providing two or three orthogonally aligned antennae, is known, particularly in the field of wireless data communication, such as is employed in wireless local area network (LAN) cards, Bluetooth®, wireless routers and the like. It has also been considered in the field of mobile cellular telecommunications where the provision of one or more secondary antennae might provide a more reliable, stable, improved and/or effective connection between the base station or signal broadcast mast and the mobile device. For instance, *Proc. IEEE, vol.* 92, Feb. 2004 (Paulraj et al.) demonstrates that multiple antenna designs are much desired in wireless applications, as they provide significant improvements in signal reliability and data rates.

Polar antennae arrangements are also known to be spatially more efficient in that they can be effectively miniaturized, and as such prove invaluable for mobile cellular devices where overall product size is of critical importance. (See *IEEE Trans. Commun., vol. COM*-20, Oct. 1972, Lee & Yeh).

A technique known as spatial multiplexing is also known wherein three separate data signals can be transmitted by transmitting/receiving three separate electromagnetic waves, each having one of the three possible linear polarizations of the electric field. It is to be mentioned that the polarisation axes are traditionally, but not necessarily, orthogonal. The ability to communicate three data streams simultaneously in this manner can increase the overall data throughput by a factor of 3 (*Nature*, vol. 409, Jan. 2001, Andrews, Mitra, and Carvalho).

U.S. Pat. No. 6,844,858 to Andrews, Mitra, and Gans further discloses that in a rich scattering environment, there are potentially six, and not merely two or three, independent polarization channels available for the transmission of data. However, this allegation is considered contentious because for free space propagating wave, the magnetic field component is a relativistic manifestation of the electric field component. Therefore there are only 3 available channels, ignoring inductive non-propagating effects. Notwithstanding this, the document discloses a simplified version of a tri-polar antenna which might be considered for use in the invention described. This is shown in FIG. 1 hereof, and the two dipole elements 100 and 105 and the loop element 110 which are said to provide the threefold polarization diversity, and the orthogonal arrangement of two of dipole elements 100 and 105 can clearly be seen. Importantly, this arrangement is described in the patent as being useful for transmitting and/or receiving over a subset of the notional six polarization channels, and specifically a 3 channel communication system is proposed using two mutually orthogonal electric field polarisations and a magnetic field polarised in the third orthogonal direction. As will be immediately understood by those skilled in the art, from FIG. 1 the two perpendicularly arranged dipoles transmit/receive the two mutually orthogonal polarisations of electric field, whereas the loop element transmits/receives the magnetic field polarised in the third orthogonal direction, i.e. predominantly about an axis coincident with the geometric centre of the loop.

One disadvantage of the antenna shown in FIG. 1 is that each of the three antenna are superposed. In the patent, the arrangement of the various elements is described as being substantially in a plane, but actually planar configuration is impossible due to superposition of each of the elements. In applications where space is at a premium, such arrangements may be precluded.

A more pervasive disadvantage of this arrangement is that the loop element does not provide a useful antenna for the reception or transmission of an electric field polarised in the third orthogonal direction. Indeed, the fundamental inventive realisation behind U.S. Pat. No. 6,844,858, and by which it is concluded that there are potentially six independent polarisation channels, is that for a suitable arrangement of antennae transmitting or receiving electromagnetic waves, there are 3 components of electric field, namely two transverse components, and a longitudinal component. The transverse components are capable of propagating from one antenna to another as a result of being disposed in a rich scattering environment, while the longitudinal component propagates directly through space.

As is known by those skilled in the art, electromagnetic waves are generally polarised in directions orthogonal to the propagation direction, and thus $\underline{E}$ and $\underline{H}$ components (from Maxwell's equations governing electromagnetic theory, $\underline{E}$ being the electric field vector and $\underline{H}$ being the magnetic field vector) are typically orthogonal to one another in the far-field—it is these physical factors which led the inventors to deduce that 6 independent channels (3 using $\underline{E}$ and 3 using $\underline{H}$) may exist. However, it is known that $\underline{E}$ and $\underline{H}$ are only sufficiently de-coupled so as to be considered independent in the near-field (for example over the order of a few meters) as opposed to the far-field (for example between mobile telephones and their most proximate transmission/reception antenna, i.e. a few hundred meters or even a few km).

It is an object of the invention therefore to provide an antenna with multiple polarizations that is of generally planar configuration which is compatible with printed circuit board production techniques.

It is a further object of this invention to provide an antenna capable of transmitting/receiving electromagnetic radiation having three different electric field polarizations.

BRIEF SUMMARY OF THE DISCLOSURE

According to the present invention there is provided an antenna consisting of three electromagnetic signal transmitting/receiving elements, two of which being arranged such that their axes of signal transmission/reception sensitivity are not parallel, characterised in that the antenna also includes a third electromagnetic signal transmitting/receiving element comprised of at least a pair of spaced apart portions arranged such that one portion at least partially overlays the other, the separation of each portion being such that the direction of the shortest path between said portions has at least some orthogonality with the axes of signal transmission/reception sensitivity of the first two elements.

For the avoidance of doubt, the direction of the shortest line which can be drawn between the two spaced apart portions of the third electromagnetic signal transmitting/receiving element shall hereinafter be referred to as the axis of separation.

Preferably, the axis of separation is substantially perpendicular to both the axes of signal transmission/reception of the first two transmitting/receiving elements, which are themselves preferably substantially perpendicular.

Preferably, each of said signal transmitting/receiving elements is provided on or in a substrate of dielectric material.

Further preferably, portions of said substantially perpendicular two elements are coplanar.

Preferably the two substantially perpendicular elements consist of a pair of dipoles arranged such that one pair of respective ends of said dipoles is proximate and another pair is remote.

Preferably, the third element consists of a first panel radiator of circular (or possibly possessing any other two dimensional) cross-sectional shape, a second circular panel radiator (again possibly of different cross-sectional shape).

Each of said elements may be embedded within the dielectric material substrate or alternatively applied to the upper and/or lower surfaces thereof.

In a preferred embodiment, the panels of the third element are provided on opposite sides of said dielectric material substrate.

In different embodiments, one of the panels may be larger or smaller than the other, or they may be the same size. Most preferably, each panel is arranged such that their geometric centres are concentric.

Ideally, the arrangement of all the elements of the antenna minimises cross coupling between each element.

In an alternative arrangement, the dipoles may be replaced by horizontally polarised microstrip patch elements.

DETAILED DESCRIPTION

Figure 1:
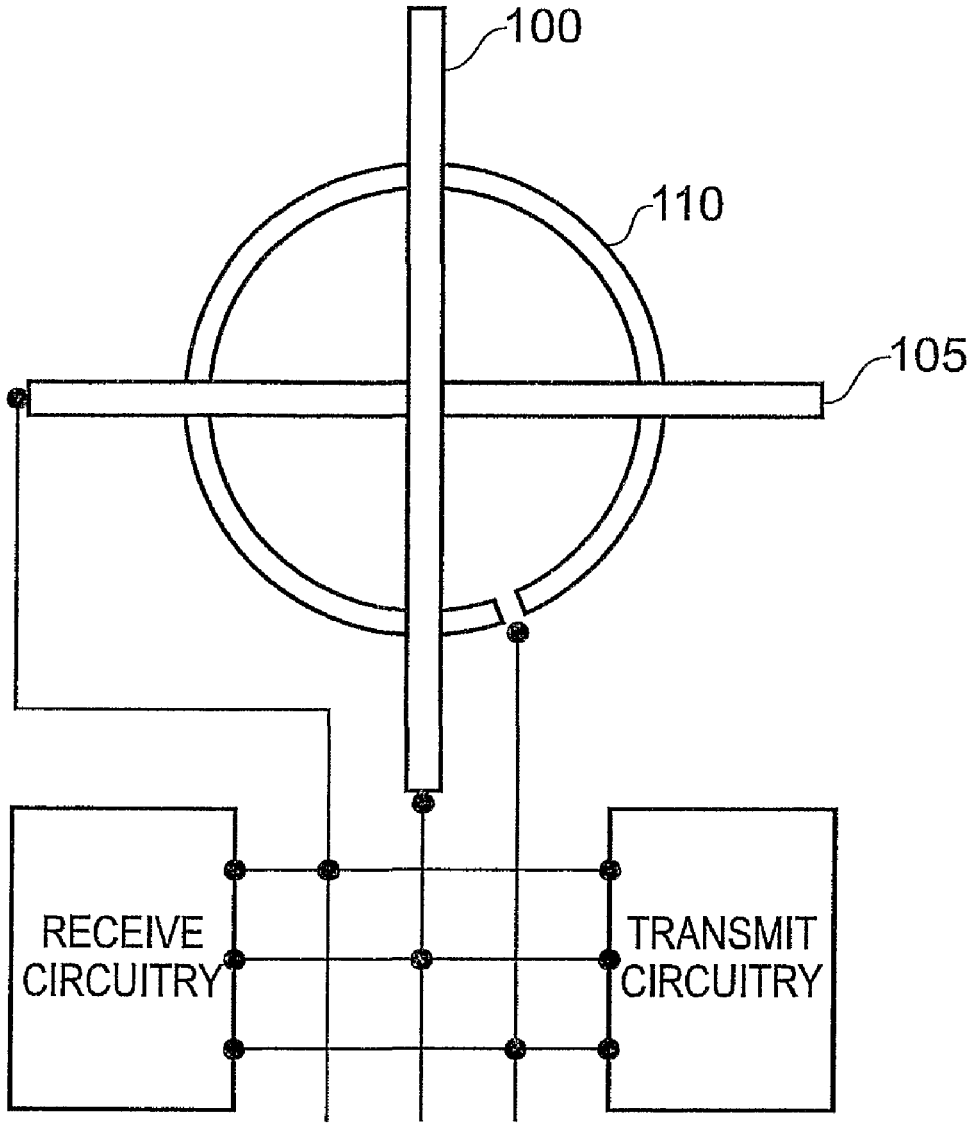
FIG. 1 (Prior Art)
FIG. 1 shows a prior art arrangement of elements constituting a tripolar antenna adapted for the transmission reception of two separate polarisations of a propagating electric field and a third, mutually orthogonal polarisation of a propagating magnetic field.
Figure 2A:
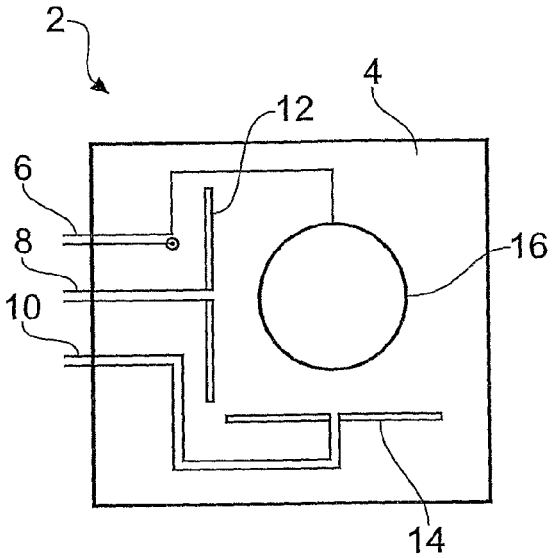
FIG. 2*a, b* provide plan views of the upper and lower surface of an antenna according to one embodiment of the invention showing the arrangement of elements.

Referring to FIGS. 2*a, b*, which shows merely one possible embodiment of the invention, the antenna 2 comprises a planar sheet 4 of dielectric forming the substrate of the device in which are provided three independent ports, 6, 8, 10.

Figure 2B:
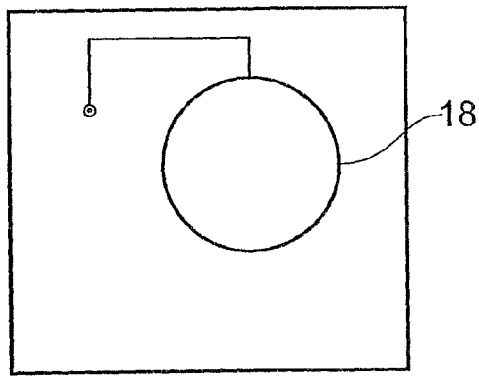

Each port is connected to the feed of one of the antenna elements through a feeder (which may be microstrip, coplanar-waveguide, coaxial cable or other suitable device). According to the illustration in the FIG. 2(*a*), the top face contains a laterally oriented dipole 12 (bow tie, or microstrip patch etc.) connected to one port; a transversally oriented dipole 14 connected to a further port; and a circular panel or disk radiator 16 to which one conductor of port 6 is connected. On the back face of the dielectric 4 is another disk 18 to which the other (ground) conductor of the port 6 is connected, and which is concentric with the top disk, as shown in FIG. 2(*b*). A design example of such an element is provided in prior publication *Electronics letters, vol.* 33, pp. 727-9, 1997 *"Patch antenna equivalent to simple monopole" by Economou & Langley*. The three ports are connected to coaxial cables or other suitable connectors. The lengths of the dipoles and the diameters of the disks (along with the dielectric constant of the substrate, e.g., FR4) determine the operating frequency of the antennas. The dipoles may be replaced by laterally and transversely polarised microstrip patch elements, which would require a ground plane beneath them. These are well established design elements.

Figure 3:
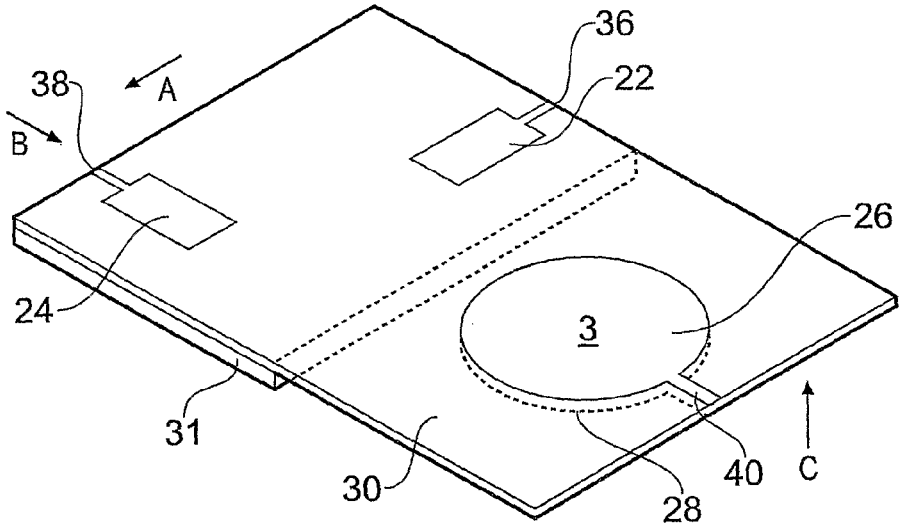
FIG. 3 shows a perspective view of an antenna according to an embodiment of the invention.

FIG. 3 shows such a structure in which two generally elongate microstrip patch antenna elements 22, 24 are provided on a high frequency laminate substrate 30 such as an RT/duroid™ substrate. The antenna elements 22, 24 are provided with their longitudinal axes generally mutually orthogonal to one another. In the embodiment of FIG. 3 the antenna elements 22, 24 are arranged to be orthogonal to a respective one of a pair of orthogonal edges of the substrate.

A ground plane 31 in the form of a sheet of conducting material is provided on a side of the substrate opposite the side on which the antenna elements 22, 24 are formed, underlying the region of the substrate over which the elements 22, 24 are formed. A conductor of each of the ports 36, 38 of antenna elements 22, 24 is connected to a respective one of each of the antenna elements 22, 24 whilst the other conductor of each port is connected to the ground plane 31. In the embodiment of FIG. 3 the ground plane is a single sheet of a metallic material. In some embodiments the conductor is a single sheet of copper. Other metals and other conducting materials are also useful. Other forms of ground plane are also useful, such as a ground plane comprising multiple patches or strips of material.

A third antenna element is provided having a circular panel or disk radiator 26 on the same side of the substrate as the antenna elements 22, 24, and a corresponding disk 28 on the reverse side of the substrate in a similar manner to the example of FIG. 2. A conductor of a port 40 of the third antenna is connected to the disk radiator 26 whilst a ground conductor of port 40 is connected to the corresponding disk 28.

The direction of polarisation of the antenna elements 22, 24 and the third antenna element 26 are indicated in FIG. 3 by arrows A, B, C respectively.

In one embodiment of the invention, configured to operate at a frequency of 2.4 GHz, the patch antenna elements 22, 24 are around 20 mm long and 5 mm wide, being generally rectangular in shape.

Some embodiments of the invention having a ground plane provided underlying the antenna elements 22, 24 are found to have reduced sensitivity to the presence of metallic objects in a vicinity of the structure.

As will be appreciated, while many of the elements contained in the invention are independently known, the present invention resides in the fact that none has been combined in this useful and innovative manner before. In this regard, the invention provides a compact antenna design consisting of three independent elements dielectrically isolated from one another and having a planar construction and can transmit and receive all three possible orthogonal polarisations of a propagating electric field, in particular the E field of a propagating electromagnetic wave. It is to be mentioned that the elements do not need to be arranged in exactly orthogonal relationship described above. For instance, the dipole elements may be arranged at an acute or obtuse angle to one another, and furthermore, the circular disk elements may be embedded partially or fully in the delectric material, and furthermore orientated at a desired elevation relative to the notional z plane, where the x and y axes are in the plane containing the dielectric substrate and the two dipoles.

The tripolar transmitter/receiver can be configured to act as three independent antennas carrying three separate information streams (signals) or can be configured to operate as a "diversity combining antenna" which can be used to enhance the signal transmission/reception quality of information (bit error rate—BER), or both, optionally in an adaptive configuration.

Each antenna element is capable of transmitting (or receiving) electromagnetic waves with one of the three possible linear polarisations of the electric field, thereby spanning the full polarisation basis. In this way, an arbitrarily polarised wave can be transmitted or received from any direction. The three elements can have individual feeds and can therefore be excited independently. As a result, they can carry independent signals useful for spatial (polarisation) multiplexing. The antennas can also be configured to transmit/receive the same information signal through all three polarisations. This allows for the system to be operated as a "diversity" antenna array. There is also the possibility of operating in a combination of both configurations, adapting between the two depending on whether a reliable and robust link is required or a high capacity link is required. It is also possible that two antennas can be operated as a diversity antenna system (both elements carrying the same signal) and the third operating as an independent antenna carrying another information stream.

As a result of the planar and compact nature of the antenna, such can be easily placed on a flat surface, such as the back plate of a mobile phone, a laptop PCMCIA card, or the windshield of a car. It can be directly fabricated as a planar structure, reducing the manufacturing complexity and cost.

Figure 4:
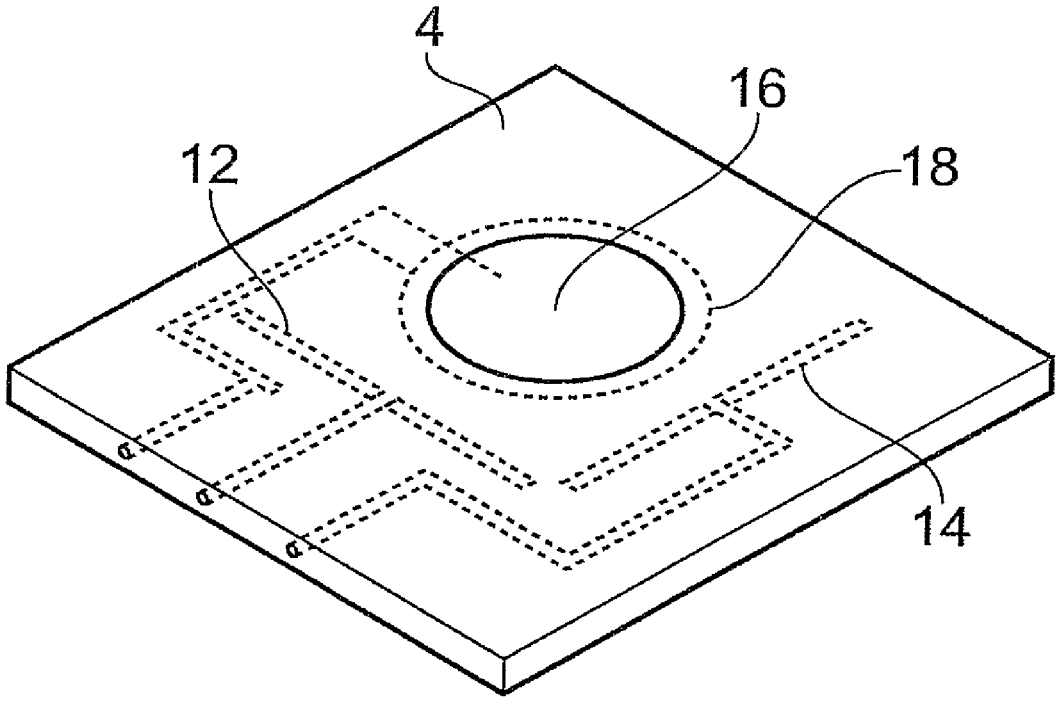
FIG. 4 shows a perspective view of a possible further embodiment of an antenna according to the invention.

Referring finally to FIG. 4, a further embodiment of the invention is shown wherein the dipole elements are both embedded or encased in the dielectric material, and the circular disk elements are provided on the upper and lower surfaces thereof. There are different variations of this configuration which are possible, and FIG. 4 shows only one possible configuration. For example, to a greater or lesser extent, each element may be either wholly encased within the dielectric material, partially inset or recessed, or mounted directly on the surface of the dielectric material. All such configurations are considered within the scope of this invention.

It is also to be mentioned that the transmission/reception characteristics of the antenna may be changed by scaling the dielectric. In particular, by suitable selection of dielectric material, thickness, and shape, the antenna may be designed to be particularly effective at a particular frequency. Also, the first two elements may be monopole elements as opposed to dipoles. Also, instead of supplying electric current to the disk radiators through their edges, they may be centre-fed.

Other antenna element designs are possible, such as wideband elements.

In terms of backwards compatibility with existing mobile telecommunications networks (to which this invention is ideally suited), such communications are currently achieved using a single dominant polarisation of electromagnetic radiation. Hence with this arrangement, not only can the potential bandwidth be tripled, but backwards compatibility with existing networks can be maintained in new devices embodying the new antenna and means of signal communication.

Possible uses for each of the three channels made available by this invention are:

providing different frequencies for communication;

providing different data streams over the 3 channels at the same frequency;

providing uplink, downlink etc. on separate channels.

In summary therefore, a planar tripolar antenna is described having at least two electromagnetic signal transmitting/receiving elements arranged such that their axes of signal transmission/reception sensitivity are not parallel, wherein the said elements are provided on or at least partially in a substrate of dielectric material so portions of the said, at least two elements are coplanar and dielectrically isolated from one another. In a preferred arrangement, two dipoles are provided on the substrate in perpendicular orientation and in the plane containing of the surface of said dielectric material. A further third element is provided so as to render the antenna tripolar, said third element comprising a first circular disk element secured to an upper surface of the dielectric material, and a second element, concentrically positioned on the corresponding opposite and lower surface of the dielectric.

The invention claimed is:

1. A planar tripolar antenna, comprising:

first and second electromagnetic signal transmitting/receiving elements arranged such that their axes of signal transmission/reception sensitivity are not parallel; and a third electromagnetic signal transmitting/receiving element comprising at least a pair of spaced apart corresponding panels separated by a dieletric material and arranged such that one panel overlays the other, the separation of each corresponding panel being such that the direction of the shortest path between said corresponding panels of the third element has at least a degree of perpendicularity with the axes of signal transmission/reception sensitivity of the first and second elements.

2. An antenna according to claim 1 wherein the direction of the shortest path between the panels of the third element defines an axis of separation which is substantially perpendicular to both the axes of signal transmission/reception of the first and second transmitting/receiving elements.

3. An antenna according to claim 1 wherein the axes of signal transmission/reception sensitivity of the first and second elements are themselves preferably substantially perpendicular.

4. An antenna according to claim 1 wherein portions of the first and second elements are coplanar.

5. An antenna according to claim 1 wherein each of the signal transmitting/receiving elements is provided on or in a substrate of dielectric material.

6. An antenna according to claim 5 wherein said elements are surface mounted on the dielectric substrate.

7. An antenna according to claim 6 wherein the panels of the third element are provided on opposite sides of said dielectric material substrate.

8. An antenna according to claim 6 wherein a ground plane is provided on an opposite side of the substrate to said first and second elements, the first and second elements at least partially overlying said ground plane.

9. An antenna according to claim 8 wherein substantially an entire area of each of said first and second elements overlies said ground plane.

10. An antenna according to claim 8 wherein said ground plane does not underlie panels of the third element.

11. An antenna according to claim 1 wherein the first and second elements comprise a pair of dipoles arranged such that one pair of respective ends of said dipoles is proximate and another pair is remote.

12. An antenna according to claim 1 wherein the third element comprises first and second circular panel radiators arranged in substantially superposed relationship.

13. An antenna according to claim 1 wherein the first and second elements are perpendicularly arranged monopoles or dipoles.

14. An antenna according to claim 1 wherein one or more of the first, second, and third elements are horizontally polarised microstrip patch elements.

* * * * *